US006568033B2

(12) United States Patent
Kim

(10) Patent No.: US 6,568,033 B2
(45) Date of Patent: May 27, 2003

(54) HINGE STRUCTURE OF TRUNK LID FOR AUTOMOBILE

(75) Inventor: Yong-Soo Kim, Ulsan (KR)

(73) Assignee: Hyundai Motor Company, Seoul (KR)

( * ) Notice: Subject to any disclaimer, the term of this patent is extended or adjusted under 35 U.S.C. 154(b) by 186 days.

(21) Appl. No.: 09/753,252

(22) Filed: Dec. 27, 2000

(65) Prior Publication Data

US 2001/0005920 A1 Jul. 5, 2001

(30) Foreign Application Priority Data

Dec. 29, 1999 (KR) ..... 99-64682

(51) Int. Cl.[7] ..... E05D 11/10
(52) U.S. Cl. ..... 16/334; 296/100.06
(58) Field of Search ..... 16/334, 308, 336, 16/358; 49/379, 339, 345, 346, 340, 386; 296/76, 100.06; 180/69.21

(56) References Cited

U.S. PATENT DOCUMENTS 4,188,684 A * 2/1980 Pennec ..... 16/358
4,206,944 A * 6/1980 Kumagai et al. ..... 180/69.21
4,223,483 A * 9/1980 Stafford ..... 49/386
4,402,111 A * 9/1983 Selby et al. ..... 16/308
4,580,315 A * 4/1986 Beckwith ..... 16/308
5,195,796 A * 3/1993 Wampler, II ..... 16/358
6,181,094 B1 * 1/2001 Menke ..... 49/340

* cited by examiner

*Primary Examiner*—Anthony Knight
*Assistant Examiner*—Doug Hutton
(74) *Attorney, Agent, or Firm*—Christie, Parker & Hale, LLP

(57) ABSTRACT

A hinge structure of a trunk lid for an automobile adapted to prevent a user from being hurt by a closing trunk lid due to a weakened resilience of an aged torsion bar, is provided. The structure includes a hinge bracket fixed to a package tray at a body, a hinge arm rotatably supported at one side thereof to the hinge bracket and fixed at the other side thereof to a bottom side of the trunk lid and a torsion bar mounted between the hinge arm and the hinge bracket for receiving resilience in a direction in which the hinge arm is opened. The structure also includes a guide bracket integrally formed with the hinge bracket having a trace on which the hinge arm moves, and multi-stage control structure mounted between the guide bracket and the hinge arm for resiliently controlling a position of the hinge arm at multi-stages.

7 Claims, 3 Drawing Sheets

HINGE STRUCTURE OF TRUNK LID FOR AUTOMOBILE

CROSS-REFERENCE TO RELATED APPLICATION

This application claims priority of Korea patent Application No. 99-64682, filed on Dec. 29, 1999.

BACKGROUND OF THE INVENTION

1. Field of the Invention

The present invention relates to a hinge structure, and more particularly to a hinge structure of trunk lid for automobile adapted to resiliently support-an opened state of a trunk lid when the trunk lid is openably and closeably mounted.

2. Description of the Prior Art

Generally, an automobile is formed at a front or at a rear part thereof with a trunk room and the trunk. room is mounted with a trunk lid for opening and closing the trunk room.

The trunk lid is supportively hinged at one side thereof and is locked/unlocked at the other side thereof by a ratchet assembly and a striker.

At this time, as illustrated in FIGS. 4 and 5, the hinged assembly is constituted by a hinge bracket 51 fixed to a package tray 50 at a body, a hinge arm 52 rotably supported at one side thereof to the hinge bracket 51 and fixed at the other side thereof to a bottom side of a trunk lid (T) and a torsion bar 53 mounted between the hinge arm 52 and the hinge bracket 51 for receiving resilience to a direction to which the hinge arm 52 is opened.

Of course, the torsion bar 53 is formed at a tip end thereof with a torsion part 54 for twisting the torsion bar 53 and is supported at both ends thereof by both sides of the hinge bracket 51 while the torsion bar 53 is supported by a link 55 which is in turn rotably supported at one end thereof by the hinge arm 52.

When the torsion part 54 is linked to the link 55, the torsion part 54 is rotated to twist the torsion bar 53 while the trunk lid (T) is closed, and when the trunk lid (T) is opened under this situation, and trunk lid (T) receives resilience to a direction to which the trunk lid (T) is opened by the twisting resilience, thereby enabling to maintain the opened state However, there is a problem in that the trunk lid (T) cannot keep the opened state while the torsion bar 53 is aged to weaken the resilience when the twisting resilience of torsion bar is used to maintain the opened state of the trunk lid (T), such that the trunk lid (T) tends to close to thereby hurt a user when he or she puts luggage into a trunk room.

SUMMARY OF THE INVENTION

The present invention is disclosed to solve the aforementioned problems and it is an object of the present invention to provide a hinge structure of trunk lid for automobile adapted to prevent a user from being hurt by a closing trunk lid when the trunk lid is closed by weakened resilience when a torsion bar is aged.

In accordance with the object of the present invention, there is provided a hinge structure of trunk lid for automobile, the structure including a hinge bracket fixed to a package tray at a body, a hinge arm rotably supported at one side thereof to the hinge bracket and fixed at the other side thereof to a bottom side of a trunk lid and a torsion bar mounted between the hinge arm and the hinge bracket for receiving resilience to a direction to which the hinge arm is opened, the structure comprising:

a guide bracket integrally formed with the hinge bracket for receiving a trace where the hinge arm moves; and multi-stage control means mounted between the guide bracket and the hinge arm for resiliently controlling a position of the hinge arm multi-stages.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
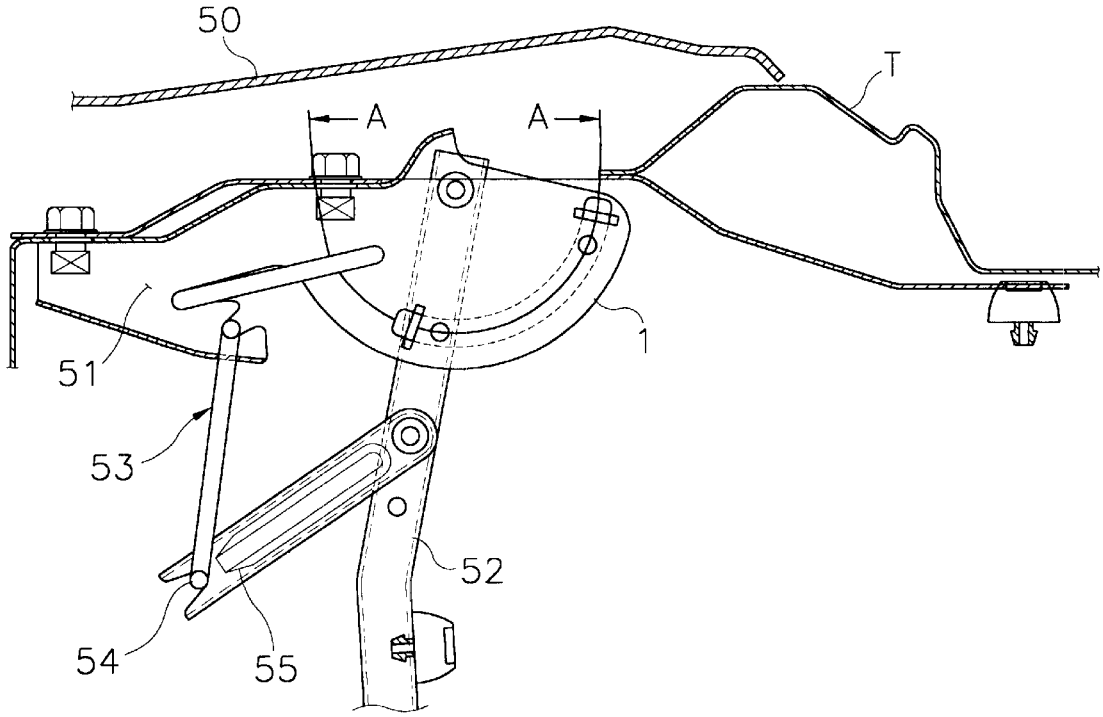
FIG. 1 is a side view for illustrating a hinge structure of trunk lid for automobile according to the-present invention.
Figure 2:
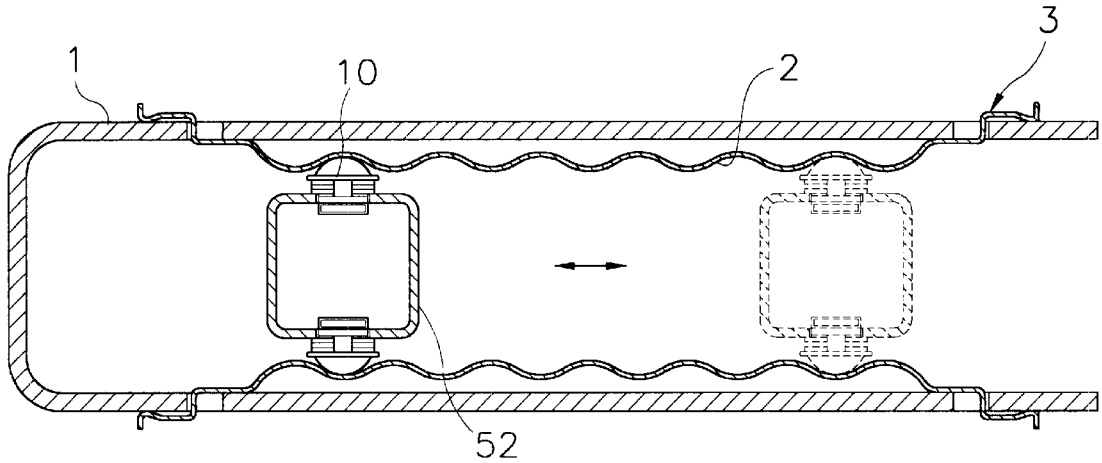
FIG. 2 is a sectional view taken along line A—A of FIG. 1.

As illustrating in FIGS. 1 and 2, the hinge structure includes a guide bracket 1 integrally formed with the hinge bracket 51 for receiving a trace where a hinge arm 52 moves, and multi-stage control means mounted between the guide bracket 1 and the hinge arm 52 for resiliently controlling a position of the hinge arm 52 at multi-stages.

In other words, the hinge structure serves to resiliently restrain the position of the hinge arm 52 to prevent the trunk lid (T) from descending when the position is fixed by resilience of a torsion bar 53 while the trunk lid (T) is opened.

The multi-stage control means includes resilient plates 3 each coupled to the guide bracket 1, and formed with a sequential curvature 2, and stopping means mounted at the hinge arm 52 so as to be tightly abutted to the resilient plate 3, where the guide bracket 1 is made to shape like a box to arrange each resilient plate 3 to face from each side and to mount the hinge arm 52 with two stopping means, further improving a position fixing power of the hinge arm 52.

At this time, the resilient plate 3 is comprised of a plurality of fixation slots 4, each arranged at a predetermined space at the guide bracket 1 and a hitching unit 5 formed at both sides of the resilient plate 3 so as to be inserted into and secured at both sides f the resilient plate 3.

Figure 3:
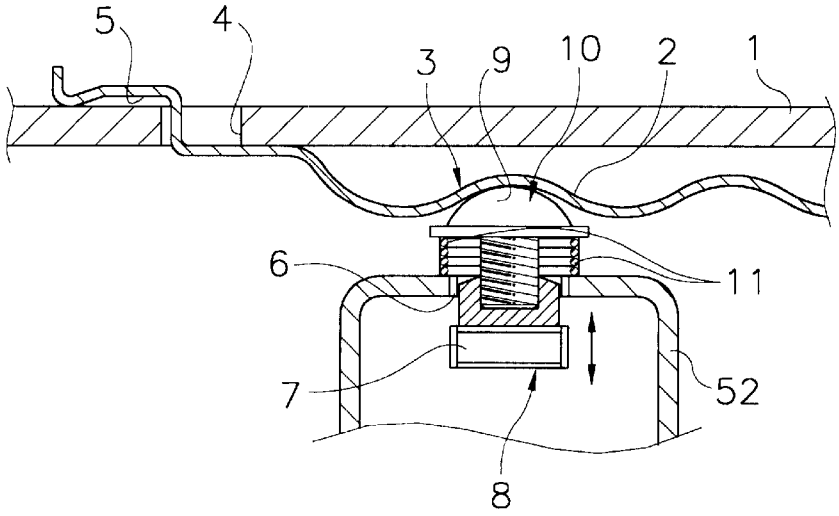
FIG. 3 is an enlarged sectional view of principal parts in FIG. 2.
Figure 4:
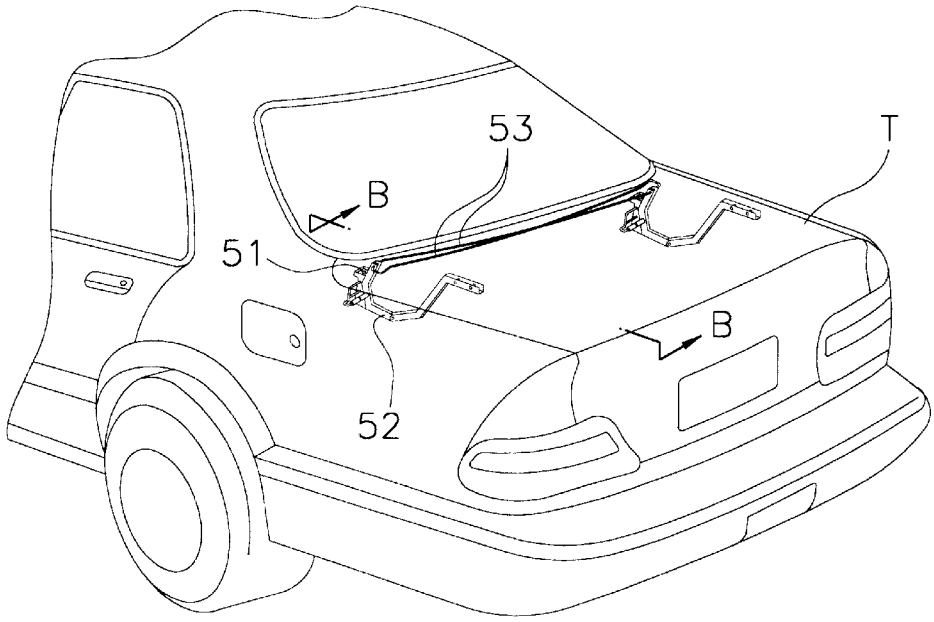
FIG. 4 (prior art)
FIG. 4 is a schematic drawing for illustrating a mounted state of hinge structure of trunk lid for automobile according to the prior art.
Figure 5:
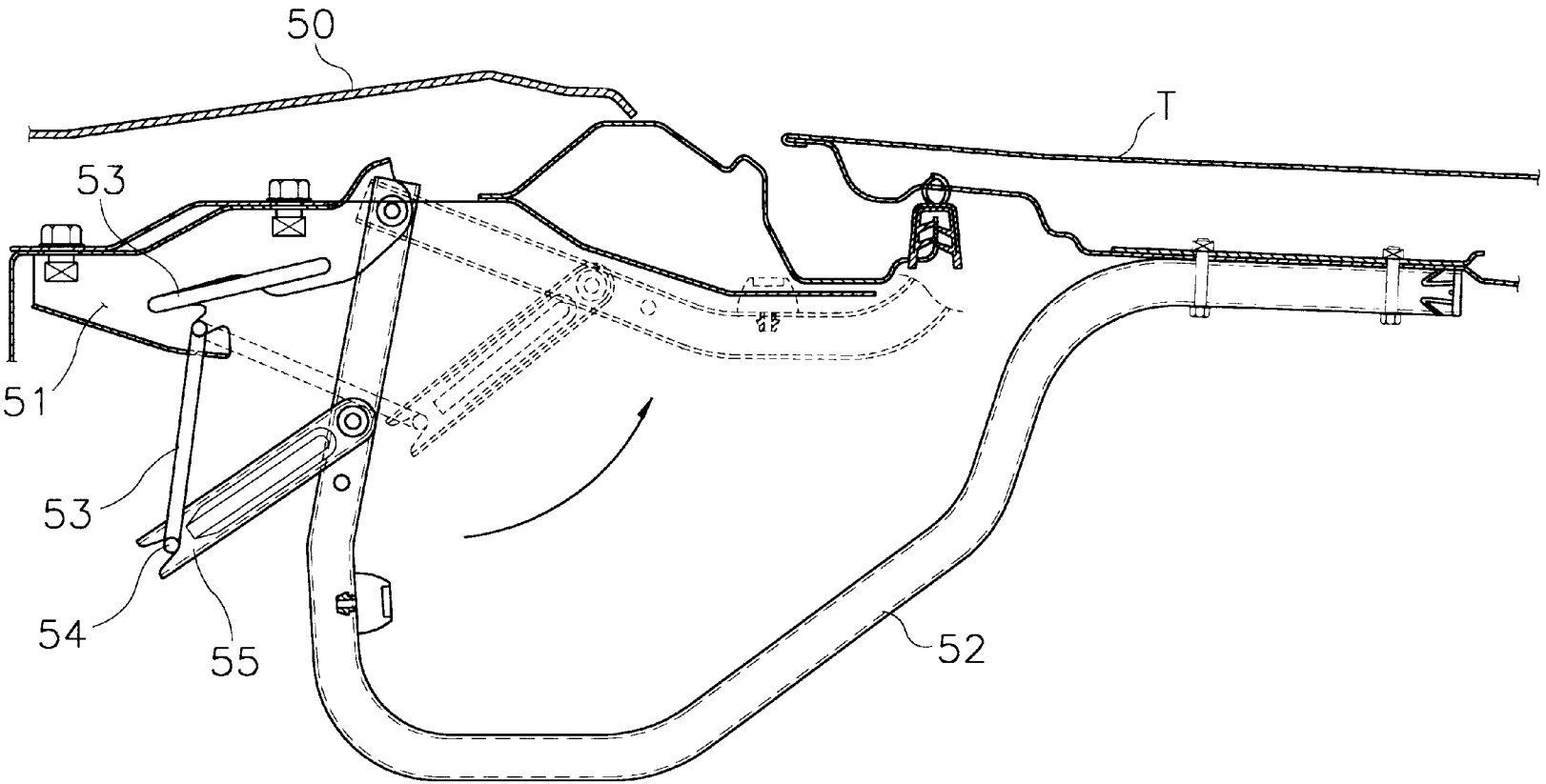
FIG. 5 (prior art)
FIG. 5 is a sectional view taken along line B—B of FIG. 4.

As illustrated in FIG. 3, the stopping means includes a mounting slot 6 formed at the vicinity of the resilient plate 3 of the hinge arm 52, a fixation pin 8 inserted into the mounting slot 6 and formed with a flange 7 for preventing breakaway from the mounting slot 6, a contact member 10 screwed to the fixation pin 8 and formed with a semi-circular contact unit 9 for contacting the resilient plate 3, and a spring 11 mounted between the contact member 10 and the hinge arm 52 for resiliently pressing the contact member 10 toward the resilient plate 3.

In other words, while the contact member 10 and the fixation pin 8 are coupled, the contact member 10 reciprocates in the mounting slot 6 by the curvature 2 of the resilient plate 3 to press the resilient plate 3.

Now, operational effect of the present invention thus constructed will be described.

When the trunk lid (T) is opened to load luggage into the trunk room, the trunk lid (T) is lifted upto a predetermined distance by torsional resilient of the torsion bar 53. When the trunk lid (T) is opened upto a predetermined level, a worker holds the trunk lid (T) to open same to as wide as possible, where the contact member 10 moves along the curvature 10 of the resilient plate 3 and reciprocates in the mounting slot 6.

While the contact member 10 is reciprocated by the curvature 2 of the resilient plate 3, and when the trunk lid (T) is opened to the maximum, the contact member 10 becomes positioned at a recess part of the curvature, where the worker hands off from the trunk lid (T).

When the worker hands off from the trunk lid (T), the trunk lid (T) receives a resilience of; maintaining the opened state by the torsion bar 53, where the contact member 10 becomes closely abutted on the recess part of the resilient plate 3 by resilience of the spring 11, thereby maintaining the openness of the trunk lid (T).

In other words, the contact member 10 keeps being inserted in the recess part of the resilient plate 3 by the resilience of the spring 11, such that, unless external force is applied to the trunk lid (T), the contact member 10 cannot ride over the curvature 2 to thereby enable to maintain the opened state of the trunk lid (T).

Particularly, even if the torsion bar 53 is worn out to a weakened resilience, the contact member 10 prevents the trunk lid (T) from descending due to its close contact with the curvature 2 of the resilient plate 3.

When the worker holds to lift the trunk lid (T), the contact member 10 smoothly moves because of its roundness at tip thereof, and when resilience of the spring 11 is adjusted, the contact member 10 smoothly rides over the curvature 2 while the opened state of the trunk lid (T) is easily maintained.

At this time, the flange 7 at the fixation pin 8 is hitched when the contact member 10 reciprocates, such that the contact member 10 is actually avoided from departing from the mounting slot 6.

As apparent from the foregoing, there is an advantage in the hinge structure of trunk lid for automobile thus described according to the present invention in that a guide bracket is mounted to prevent a trunk lid from closing when a torsion bar installed to maintain an opened state of the trunk lid by applying resilience thereto is worn out, and a contact member is mounted thereto to move in multi-stage resilience, thereby preventing a worker from being hurt due to closing trunk lid.

What is claimed is:

1. A hinge structure for a trunk lid of an automobile, the structure including a hinge bracket fixed to a package tray at a body, a hinge arm rotatably supported at one side thereof to the hinge bracket and fixed at the other side thereof to a bottom side of the trunk lid and a torsion bar mounted between the hinge arm and the hinge bracket, the structure comprising:

a guide bracket integrally formed with the hinge bracket having a trace followed by the hinge arm as the hinge arm moves between a first and a second position; and multi-stage control means mounted between the guide bracket and the hinge arm for resiliently controlling and releasably fixing a position of the hinge arm at at least one location between the first and second positions.

2. A hinge structure for a trunk lid of an automobile, the structure including a hinge bracket fixed to a package tray at a body, a hinge arm rotatably supported at one side thereof to the hinge bracket and fixed at the other side thereof to a bottom side of the trunk lid and a torsion bar mounted between the hinge arm and the hinge bracket, the structure comprising:

a guide bracket integrally formed with the hinge bracket having a trace followed by the hinge arm; and multi-stage control means mounted between the guide bracket and the hinge arm for resiliently controlling a position of the hinge arm at multi-stages, wherein the multi-stage control means comprises, resilient plates coupled to the guide bracket and formed with a sequential curvature, and stopping means mounted at the hinge arm tightly abutted to the resilient plates.

3. The structure as defined in claim 2, wherein the guide bracket comprises two opposing sides, wherein a resilient plate is mounted on each side, wherein two mounted resilient plates face each other, and wherein the hinge arm with two stopping means is mounted between the two resilient plates.

4. The structure as defined in claim 2 or 3, wherein each resilient plate comprises:

a plurality of fixation slots, each arranged at a predetermined space at the guide bracket; and a hitching unit formed at each end of each resilient plate so as to be inserted through a corresponding fixation slot and secured to the guide bracket.

5. The structure as defined in claim 2 or 3, wherein each stopping means comprises:

a mounting slot formed at the vicinity of the resilient plate of the hinge arm;

a fixation pin inserted into the mounting slot and formed with a flange for preventing breakaway of the fixation pin from the mounting slot;

a contact member screwed to the fixation pin and formed with a semi-circular contact unit for contacting the resilient plate; and a spring mounted between the contact member and the hinge arm for resiliently pressing the contact member toward the resilient plate.

6. A hinge structure for a trunk lid of an automobile, the structure including a hinge bracket fixed to a package tray at a body, a hinge arm rotatably supported at one side thereof to the hinge bracket and fixed at the other side thereof to a bottom side of the trunk lid and a torsion bar mounted-between the hinge arm and the hinge bracket, the structure comprising:

a guide bracket integrally formed with the hinge bracket having a trace followed by the hinge arm;

a resilient plate coupled to the guide bracket and formed with a sequential curvature; and a stopper mounted at the hinge arm and abutted against the resilient plate.

7. The structure of claim 6 further comprising another resilient plate and another stopper mounted at the hinge arm, wherein one of said stoppers abuts one of said resilient plates and wherein said another stopper abuts said another resilient plate.

* * * * *